US009870845B2

(12) United States Patent
Nagahashi

(10) Patent No.: US 9,870,845 B2
(45) Date of Patent: Jan. 16, 2018

(54) MULTI-LAYER COAXIAL CABLE

(71) Applicant: Yazaki Corporation, Tokyo (JP)

(72) Inventor: Mitsuharu Nagahashi, Susono (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/556,876

(22) Filed: Dec. 1, 2014

(65) Prior Publication Data

US 2015/0083459 A1 Mar. 26, 2015

Related U.S. Application Data

(63) Continuation of application No. PCT/JP2013/071285, filed on Aug. 6, 2013.

(30) Foreign Application Priority Data

Aug. 10, 2012 (JP) ..... 2012-177738

(51) Int. Cl.

| | |
|---|---|
| ***H01B 11/18*** | (2006.01) |
| ***H01B 7/02*** | (2006.01) |
| ***H01B 9/04*** | (2006.01) |
| ***H01B 1/02*** | (2006.01) |
| ***H01B 9/02*** | (2006.01) |
| *H01B 9/00* | (2006.01) |

(52) U.S. Cl.

CPC ..... *H01B 7/0225* (2013.01); *H01B 1/023* (2013.01); *H01B 9/02* (2013.01); *H01B 9/04* (2013.01); *H01B 9/003* (2013.01)

(58) Field of Classification Search

CPC ..... H01B 9/02; H01B 7/225; H01B 11/18
USPC ..... 174/107
See application file for complete search history.

(56) References Cited

U.S. PATENT DOCUMENTS 2,576,163 A * 11/1951 Baguley ..... H01B 11/18 156/55
2,849,693 A * 8/1958 Eglin ..... H01B 11/18 174/105 R
6,207,900 B1 3/2001 Wagner
(Continued)

FOREIGN PATENT DOCUMENTS

DE 102006059122 A1 6/2008
EP 0886283 A2 12/1998
(Continued)

OTHER PUBLICATIONS

International Preliminary Report on Patentability dated Feb. 10, 2015 issued in International Application No. PCT/JP2013/071285 (PCT/IB/373).

(Continued)

*Primary Examiner* — Hoa C Nguyen
*Assistant Examiner* — Stanley Tso
(74) *Attorney, Agent, or Firm* — Sughrue Mion, PLLC

(57) ABSTRACT

A multilayer coaxial cable includes high-voltage circuits that are coaxially disposed with each other. The high-voltage circuits include high-voltage conductors and high-voltage insulators that are disposed on the outside of the high-voltage conductors. In addition, the multilayer coaxial cable includes a conductive shield member that is coaxially disposed on the outside of the high-voltage circuits, and an insulating coating member that is coaxially disposed on the outside of the shield member.

9 Claims, 8 Drawing Sheets

(56) References Cited

U.S. PATENT DOCUMENTS

| | | | | |
|---|---|---|---|---|
| 7,740,501 | B2 | 6/2010 | Ballard et al. | |
| 2009/0011639 | A1 | 1/2009 | Ballard et al. | |
| 2011/0061890 | A1* | 3/2011 | Amato | H01B 11/1826 174/107 |
| 2011/0088944 | A1 | 4/2011 | Ogue et al. | |
| 2011/0162866 | A1* | 7/2011 | Masakazu | H01B 11/002 174/103 |
| 2012/0181059 | A1* | 7/2012 | Radermacher | H01B 9/04 174/115 |
| 2013/0248246 | A1 | 9/2013 | Oga | |
| 2013/0264114 | A1 | 10/2013 | Toyama | |
| 2014/0014395 | A1 | 1/2014 | Toyama et al. | |
| 2014/0165392 | A1 | 6/2014 | Toyama et al. | |

FOREIGN PATENT DOCUMENTS

| | | | | |
|---|---|---|---|---|
| EP | 1 126 997 | | 9/2002 | |
| JP | 2002-529299 | A | 9/2002 | |
| JP | 2010-12868 | A | 1/2010 | |
| JP | 2012-125097 | A | 6/2012 | |
| JP | 2012-142091 | A | 7/2012 | |
| JP | 2012-151056 | A | 8/2012 | |
| JP | 2013-42648 | A | 2/2013 | |
| JP | 2013-131484 | A | 7/2013 | |
| WO | 00/27672 | A1 | 5/2000 | |
| WO | WO2000/027672 | A1 * | 5/2000 | B60L 11/06 |
| WO | 2008149236 | A2 | 12/2008 | |
| WO | 2012098906 | A1 | 7/2012 | |

OTHER PUBLICATIONS

Written Opinion dated Dec. 7, 2011 issued by the International Searching Authority in International Application No. PCT/JP2013/071285 (PCT/ISA/237).

International Search Report dated Sep. 10, 2013 issued in International Application No. PCT/JP2013/071285 (PCT/ISA/210).

Written Opinion dated Sep. 10, 2013 issued in International Application No. PCT/JP2013/071285 (PCT/ISA237).

Extended European Search Report dated Mar. 7, 2016, by the European Patent Office in counterpart European Application No. 13828404.7.

Office Action dated May 23, 2016 issued by the State Intellectual Property Office of the People's Republic of China in counterpart Chinese Patent Application No. 201380031257.7.

Communication Rule 71(3) dated Aug. 24, 2016, from the European Patent Office in counterpart European Application No. 13828404.7.

Communication dated Jul. 21, 2016, from the Japanese Patent Office in counterpart application No. 2012-177738.

Communication dated Dec. 16, 2016, from the State Intellectual Property Office of People's Republic of China in counterpart Application No. 201380031257.7.

Communication dated Jun. 26, 2017, issued by the State Intellectual Property Office of P.R. China in counterpart Chinese application No. 201380031257.7.

* cited by examiner

MULTI-LAYER COAXIAL CABLE

CROSS REFERENCE TO RELATED APPLICATIONS

This application is a continuation of PCT application No. PCT/JP13/071,285, which was filed on Aug. 6, 2013 based on Japanese Patent Application (No. 2012/177738) filed on Aug. 10, 2012, the contents of which are incorporated herein by reference.

BACKGROUND OF THE INVENTION

1. Field of the Invention

The present invention relates to a multilayer coaxial cable including a plurality of high-voltage circuits.

2. Description of the Related Art

FIGS. 8A to 8C are views illustrating high-voltage electrical power cables as examples of the related art. As illustrated in FIGS. 8A to 8C, in a hybrid vehicle or an electric vehicle, a battery 101 and an inverter unit 102 are electrically connected together through two high-voltage electrical power cables 103 (refer to PTL 1). The two high-voltage electric power cables 103 are cables for high-voltage use, and are respectively thick cables. Out of the two high-voltage electrical power cables 103, one cable is used as a positive circuit, and the other cable is used as a negative circuit. The two high-voltage electrical power cables 103 are routed side by side at predetermined locations.

CITATION LIST

Patent Literature

[PTL 1] JP-A-2010-12868

SUMMARY OF THE INVENTION

The two high-voltage electrical power cables 103 are thick cables, and are used in a state of being arrayed side by side. Therefore, when the battery 101 and the inverter unit 102 are electrically connected together as illustrated in FIG. 8B, it is necessary to ensure a space that is as wide as or wider than at least the width dimension W of the two cables. When the width dimension W becomes great, the size of a protective member that houses and protects the two high-voltage electrical power cables 103 (that is, an exterior member), not illustrated, becomes great.

In addition, as illustrated in FIG. 8B, the two high-voltage electrical power cables 103 are used in a state of being arrayed side by side, and therefore it is difficult to bend the cables in the direction of an arrow P. That is, when compared with the direction perpendicular to the paper surface in FIG. 8B, it is extremely difficult to bend the two high-voltage electrical power cables 103 in the direction of the arrow P. Since the cables can be bent only in restricted directions as described above, when the two high-voltage electrical power cables 103 are arrayed side by side, there is a possibility that the degree of freedom in routing the cables may be influenced. In addition, as illustrated in FIG. 8C, when the two high-voltage electrical power cables 103 are bent in the direction of the arrow P, the positions of the cable tips deviate from each other (that is, a deviation of the dimension Q). Therefore, it is necessary to set the cutting lengths for the respective high-voltage electrical power cables 103 and thus provide the two high-voltage electrical power cables 103 with different total lengths.

In addition, in a case in which the high-voltage electrical power cables 103 are inserted and housed in the protective member (in other words, the exterior member), not illustrated, it is necessary to carry out the insertion work as many times as the number of the high-voltage electrical power cables 103. For example, in a case in which the number of the high-voltage electrical power cables 103 is two, it is necessary to carry out the insertion work twice. Therefore, the workability is poor. Furthermore, in a case in which the high-voltage electrical power cables 103 are housed together with low-voltage electrical power cables, not illustrated, the number of times of the insertion work to carry out further increases.

The present invention has been made in consideration of the above-described circumstances, and an object of the present invention is to provide a multilayer coaxial cable which is capable of saving a space for the routing of the cable and decreasing the size of a protective member, and is capable of removing the restriction of the bending direction and improving the degree of freedom or workability.

To achieve the above-described object, a multilayer coaxial cable according to the present invention has the following features (1) to (9).

(1) A multilayer coaxial cable including:

a first high-voltage circuit including a first high-voltage conductor and a first high-voltage insulator that is disposed on an outside of the first high-voltage conductor coaxially with the first high-voltage conductor;

a second high-voltage circuit including a second high-voltage conductor that is disposed on an outside of the first high-voltage insulator coaxially with the first high-voltage insulator and a second high-voltage insulator that is disposed on an outside of the second high-voltage conductor coaxially with the second high-voltage conductor;

a conductive shield member that is disposed on an outside of the second high-voltage insulator coaxially with the second high-voltage insulator; and a coating member that is disposed on an outside of the shield member coaxially with the shield member.

(2) The multilayer coaxial cable according to the above-described (1), further including:

a low-voltage circuit including a low-voltage insulator that is disposed on the outside of the shield member coaxially with the shield member and a low-voltage conductor that is disposed on an outside of the low-voltage insulator coaxially with the low-voltage insulator.

(3) The multilayer coaxial cable according to the above-described (2), in which a conductor cross-sectional area of the low-voltage conductor is substantially the same as a conductor cross-sectional area of at least one of the first high-voltage conductor and the second high-voltage conductor.

(4) The multilayer coaxial cable according to the above-described (2), in which a conductor cross-sectional area of the low-voltage conductor is different from a conductor cross-sectional area of at least one of the first high-voltage conductor and the second high-voltage conductor.

(5) The multilayer coaxial cable according to any one of the above-described (1) to (4), in which one of the first high-voltage circuit and the second high-voltage circuit is a positive circuit and the other is a negative circuit.

(6) The multilayer coaxial cable according to any one of the above-described (1) to (4), further including:

a third high-voltage circuit including a third high-voltage conductor that is disposed on the outside of the second high-voltage insulator coaxially with the second high-voltage insulator, and a third high-voltage insulator that is disposed on an outside of the third high-voltage conductor coaxially with the third high-voltage conductor, in which a three-phase alternate current circuit is formed by the first high-voltage circuit, the second high-voltage circuit, and the third high-voltage circuit.

(7) The multilayer coaxial cable according to any one of the above-described (1) to (6), in which at least the first high-voltage conductor is made of aluminum or an aluminum alloy.

(8) The multilayer coaxial cable according to any one of the above-described (1) to (7), in which the shield member is made of a braid or a metal foil.

(9) The multilayer coaxial cable according to any one of the above-described (1) to (8), in which another constitution is disposed in a layer shape with respect to the first high-voltage conductor that is disposed around an electrically-conducting path, and an electrically-conducting path cross-sectional shape of the multilayer coaxial cable is a round shape.

The multilayer coaxial cable of the above-described (1) is a multilayer coaxial cable having an integrated constitution in which a plurality of the high-voltage circuits is coaxially disposed with each other, and the shield member and the coating member are coaxially disposed in the same manner. Therefore, when the width of the multilayer coaxial cable of the above-described (1) and, for example, the width of a plurality of thick cables arrayed side by side or the width of a bundle of a plurality of thick cables are compared, the width of the multilayer coaxial cable of the above-described (1) is narrower. Therefore, when the multilayer coaxial cable of the above-described (1) is employed, it is possible to obtain a narrow width (small diameter) even when the cable includes a plurality of high-voltage circuits, a shield member, and the like. As a result, it is possible to save a space for the routing of the cable.

In addition, according to the multilayer coaxial cable of the above-described (1), since the cable has a narrow width (in other words, a small diameter), it is possible to, accordingly, select a small protective member (in other words, an exterior member), and thus reduce the size.

In addition, according to the multilayer coaxial cable of the above-described (1), since the multilayer coaxial cable has an integrated constitution as described above, the cable can be easily bent in any direction. As a result, it is possible to improve the degree of freedom in routing the cable.

In addition, according to the multilayer coaxial cable of the above-described (1), since the multilayer coaxial cable has an integrated constitution, it is possible to improve the routing properties. In addition, according to the multilayer coaxial cable of the above-described (1), it becomes easy to meet the requirement of multiple power supplies arising from the change in the vehicle environment.

In addition, according to the multilayer coaxial cable of the above-described (1), since the multilayer coaxial cable has an integrated constitution, it is possible to reduce the number of times of work to insert the cable into a protective member. As a result, it is possible to improve the workability.

The multilayer coaxial cable of the above-described (2) is a multilayer coaxial cable having an integrated constitution in which the low-voltage circuit is further disposed coaxially. Therefore, when compared with a case in which the low-voltage electrical power cable is arrayed together with thick cables, the multilayer coaxial cable of the above-described (2) has a narrower width. As a result, when the multilayer coaxial cable of the above-described (2) is employed, it is possible to provide a narrow width even when the low-voltage circuit is included.

In addition, according to the multilayer coaxial cable of the above-described (2), since the multilayer coaxial cable has an integrated constitution, it is possible to reduce the number of times of work to insert the cable into a protective member even when the low-voltage circuit is included. As a result, it is possible to improve the workability.

In addition, according to the multilayer coaxial cable of the above-described (2), since the multilayer coaxial cable has an integrated constitution, the cable can be easily bent in any direction even when the low-voltage circuit is included. As a result, it is possible to improve the degree of freedom in routing the cable.

In addition, according to the multilayer coaxial cable of the above-described (3), since the conductor cross-sectional area of the high-voltage conductor and the conductor cross-sectional area of the low-voltage conductor are substantially the same, it is possible to provide a multilayer coaxial cable suitable for a required specification.

According to the multilayer coaxial cable of the above-described (4), since the conductor cross-sectional area of the high-voltage conductor and the conductor cross-sectional area of the low-voltage conductor are different from each other, it is possible to provide a multilayer coaxial cable suitable for a required specification.

According to the multilayer coaxial cable of the above-described (5), it is possible to coaxially provide two high-voltage circuits made up of a positive circuit and a negative circuit in an integrated constitution.

According to the multilayer coaxial cable of the above-described (6), it is possible to coaxially provide three high-voltage circuits made up of three-phase alternate current circuits in an integrated constitution.

According to the multilayer coaxial cable of the above-described (7), in addition to the effects of the above-described (1) to (6), an effect that reduces the weight is exhibited since the first high-voltage conductor is made of aluminum or an aluminum alloy.

According to the multilayer coaxial cable of the above-described (8), in addition to the effects of the above-described (1) to (7), the following effect is exhibited. That is, since the shield member is made of a braid or a metal foil which is an ordinary member, it is possible to simplify the cable structure or a structure regarding the grounding of the shield member. As a result, it is possible to contribute to cost reduction, workability improvement, and the like.

According to the multilayer coaxial cable of the above-described (9), in addition to the effects of the above-described (1) to (8), the following effect is exhibited. That is, since another constitution is disposed in a layer shape with respect to the first high-voltage conductor that is disposed around an electrically-conducting path, it is possible to provide a small diameter to the entire multilayer coaxial cable. In addition, since the electrically-conducting path cross-sectional shape of the multilayer coaxial cable is a round shape, the cable has an ordinary shape, and thus it is possible to simplify the structure of the protective member that houses and protects the multilayer coaxial cable.

DETAILED DESCRIPTION OF THE EXEMPLARY EMBODIMENTS

A multilayer coaxial cable of the present embodiment is an integrated cable produced by coaxially disposing a plurality of circuits with each other. The multilayer coaxial cable of the present embodiment includes a plurality of high-voltage circuits. That is, as the high-voltage circuits, it is possible to coaxially dispose two-system circuits (two circuits), three-system circuits (three circuits), or n-system circuits (n circuits). On the outside of the plurality of the high-voltage circuits, similarly, a shield member and a coating member are coaxially disposed with each other.

The multilayer coaxial cable of the present embodiment may further include a low-voltage circuit that is coaxially disposed. In this case, the plurality of the high-voltage circuits is disposed on the inside of the shield member, and the low-voltage circuit is disposed on the outside of the shield member. Furthermore, the "high-voltage" circuit refers to a circuit used at a high voltage, and the "low-voltage" circuit refers to a circuit used at a low voltage.

First Embodiment

Figure 1:
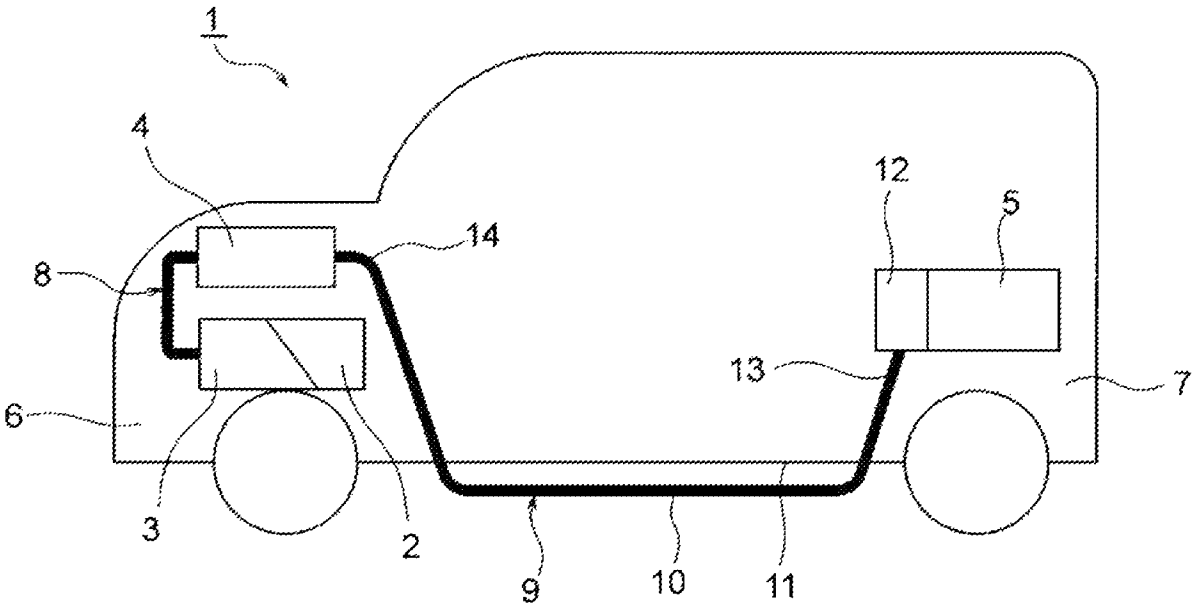
FIG. 1 is a schematic view illustrating a routing state of a wire harness.
Figure 2:
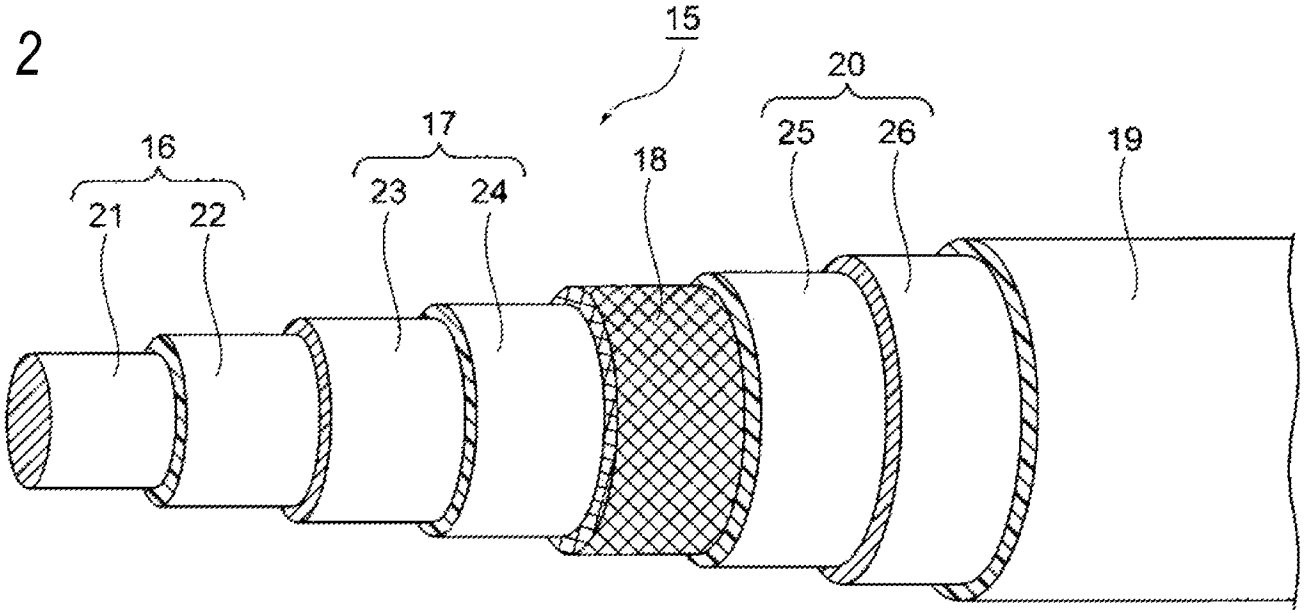
FIG. 2 is a perspective view illustrating a constitution of a multilayer coaxial cable of a first embodiment.
Figure 3:
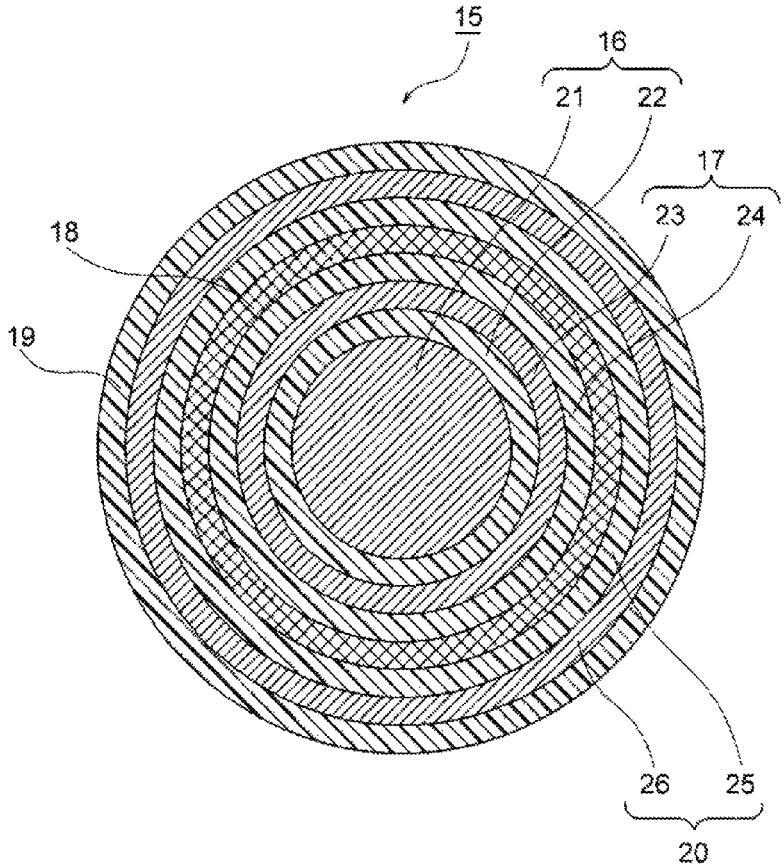
FIG. 3 is a cross-sectional view of the multilayer coaxial cable of FIG. 2.

Hereinafter, a first embodiment of the multilayer coaxial cable according to the present invention will be described with reference to FIGS. 1 to 3. FIG. 1 is a schematic view illustrating the routing state of a wire harness. In addition, FIG. 2 is a perspective view illustrating the constitution of the multilayer coaxial cable of the first embodiment, and FIG. 3 is a cross-sectional view of the multilayer coaxial cable of FIG. 2.

The first embodiment will be described using an example in which a wire harness including the multilayer coaxial cable of the first embodiment is routed in a hybrid vehicle (which may be an electric vehicle or an ordinary vehicle).

In FIG. 1, Reference Sign 1 indicates a hybrid vehicle. The hybrid vehicle 1 is a vehicle driven by mixing two powers from an engine 2 and a motor unit 3. Electric power is supplied to the motor unit 3 from a battery 5 (in other words, a battery pack) through an inverter unit 4. In this example, the engine 2, the motor unit 3, and the inverter unit 4 are mounted in an engine room 6 located near front wheels and the like. In addition, the battery 5 is mounted in a vehicle rear section 7 near rear wheels and the like. Furthermore, the battery 5 may be mounted in the inside of the vehicle present behind the engine room 6.

The motor unit 3 and the inverter unit 4 are electrically connected with each other through a high-voltage wire harness 8. In addition, the battery 5 and the inverter unit 4 are also electrically connected with each other through a high-voltage wire harness 9. The wire harness 9 has a middle section 10 routed at the bottom of a vehicle floor 11. In addition, the wire harness 9 is routed substantially parallel to the bottom of the vehicle floor 11. The bottom of the vehicle floor 11 is a well-known body and is also a so-called panel member, and has a through hole (not illustrated) in a predetermined location. The wire harness 9 is inserted into the through hole.

The wire harness 9 and the battery 5 are electrically connected with each other through a junction block 12 provided in the battery 5. A rear end 13 of the wire harness 9 is electrically connected with the junction block 12 using a well-known method. A front end 14 side of the wire harness 9 is electrically connected with the inverter unit 4 using a well-known method.

The motor unit 3 includes a motor (not illustrate) and a generator (not illustrated). In addition, the inverter unit 4 includes an inverter (not illustrated) and a converter (not illustrated). The motor unit 3 is formed in a form of a motor assembly including a shield case (not illustrated). In addition, the inverter unit 4 is also formed in a form of an inverter assembly including a shield case (not illustrated). The battery 5 is a Ni-MH-based or Li-ion-based battery, and is modularized. Furthermore, it is also possible to use, for example, an electric storage device such as a capacitor. The battery 5 is not particularly limited as long as the battery can be used in the hybrid vehicle 1 or an electric vehicle.

The wire harness 9 is provided as a member for electrically connecting the inverter unit 4 and the battery 5 as described above. The wire harness 9 includes a multilayer coaxial cable 15 illustrated in FIGS. 2 and 3 and an exterior member that houses and protects the multilayer coaxial cable 15 (in other words, a protective member), not illustrated. Furthermore, the exterior member is a metal or resin tubular body, and will not be described in detail.

In FIGS. 2 and 3, a single string of the multilayer coaxial cable 15 includes a high-voltage positive circuit 16 (first high-voltage circuit) and a high-voltage negative circuit 17 (second high-voltage circuit). That is, the multilayer coaxial cable 15 includes two-system high-voltage circuits. In addition, the multilayer coaxial cable 15 includes a shield member 18 and a coating member 19. Furthermore, the multilayer coaxial cable 15 includes a low-voltage circuit 20 between the shield member 18 and the coating member 19. The multilayer coaxial cable 15 is constituted in a form of an integrated cable by coaxially disposing all of the above-described circuits and the like with each other.

Specifically, the multilayer coaxial cable 15 includes a first high-voltage conductor 21 having a round cross-sectional shape located in the center of an electrically-conducting path (that is, the center of the multilayer coaxial cable 15) and a first high-voltage insulator 22 that coats the outer circumference of the first high-voltage conductor 21 in a predetermined thickness, and forms a layer shape. In addition, the multilayer coaxial cable 15 includes a second high-voltage conductor 23 that is provided on the outside of the first high-voltage insulator 22 and forms a layer shape and a second high-voltage insulator 24 that coats the outer circumference of the second high-voltage conductor 23 in a predetermined thickness, and forms a layer shape. Furthermore, the multilayer coaxial cable 15 includes the shield member 18 that is provided on the outside of the second high-voltage insulator 24 and forms a layer shape. Furthermore, the multilayer coaxial cable 15 includes a low-voltage insulator 25 that coats the outer circumference of the shield member 18 in a predetermined thickness, and forms a layer shape and a low-voltage conductor 26 that is provided on the outside of the low-voltage insulator 25 and forms a layer shape. Furthermore, the multilayer coaxial cable 15 includes the coating member 19 that coats the outer circumference of the low-voltage conductor 26 in a predetermined thickness, and forms a layer shape. The multilayer coaxial cable 15 is formed so that the electrically-conducting path cross-sectional shape becomes a round shape.

Regarding the constitution of the multilayer coaxial cable 15, in the present embodiment, the first high-voltage conductor 21 corresponds to a positive electrode conductor, and the second high-voltage conductor 23 corresponds to a negative electrode conductor. Furthermore, as is also clear from the above-described constitution, the multilayer coaxial cable 15 can be considered as "a high-voltage coaxial composite electrically-conducting path".

Hereinafter, the constitution will be described from the center side of the electrically-conducting path.

The first high-voltage conductor 21 is manufactured using copper, a copper alloy, aluminum, or an aluminum alloy. The first high-voltage conductor 21 may have any of a conductor structure in which strands are twisted together and a rod-shaped conductor structure having a round cross-sectional shape (for example, a conductor structure forming a round single core). In the first embodiment, twisted lines of aluminum or an aluminum alloy having a conductor cross-sectional area of 15 sq. is employed. The above-described conductor cross-sectional area or the like is an example. In the case of the first embodiment, since the first high-voltage conductor is made of aluminum or an aluminum alloy, the first high-voltage conductor is lighter in weight than a high-voltage conductor made of copper or a copper alloy. Furthermore, the structure of the first high-voltage conductor is not particularly limited as long as the first high-voltage conductor 21 can exhibit the function of the positive electrode conductor.

The first high-voltage insulator 22 is a coating with respect to the first high-voltage conductor 21, and is formed by molding a well-known insulating resin material through extrusion.

The second high-voltage conductor 23 is manufactured using copper, a copper alloy, aluminum, or an aluminum alloy. The structure of the second high-voltage conductor is not particularly limited as long as the second high-voltage conductor 23 can exhibit the function of the negative electrode conductor. In the first embodiment, the second high-voltage conductor having a conductor cross-sectional area of 15 sq. is employed when made of aluminum or an aluminum alloy, and the second high-voltage conductor having a conductor cross-sectional area of 10 sq. is employed when made of copper or a copper alloy. The above-described conductor cross-sectional area or the like is an example. For example, the conductor cross-sectional area may be set to be slightly greater than that of the first high-voltage conductor 21.

An example of the second high-voltage conductor 23 is a braid conductor produced by weaving conductive strands in a cylindrical shape. In addition, another example is a metal foil conductor produced by forming a conductive metal foil in a tubular shape. In addition, another example is a spiral conductor formed by winding a conductive metal wire rod in a screw shape. Examples of the metal wire rod for the spiral conductor include a metal wire rod having a round or rectangular cross-sectional shape, a metal wire rod having a band plate shape, a metal wire rod made of a naked cable, and the like.

In addition, an example of the second high-voltage conductor 23 is a pipe conductor made of a conductive metal pipe. The pipe conductor is manufactured through extrusion or by coiling a metal plate in a pipe shape. In addition, an example of the second high-voltage conductor 23 is a strand conductor produced by disposing a number of conductive strands around the first high-voltage insulator 22 or by unweaving naked cables and disposing the naked cables around the first high-voltage insulator 22. In addition, an example of the second high-voltage conductor 23 is a tape conductor for which conductive metal tape is used.

In a case in which the second high-voltage conductor is made of aluminum or an aluminum alloy similar to the first high-voltage conductor 21, the conductor cross-sectional area (conductor size: the cross-sectional area of a section functioning as the conductor) of the second high-voltage conductor 23 is set to match the conductor cross-sectional are of the first high-voltage conductor 21. Furthermore, when the second high-voltage conductor 23 is a braid conductor, a spiral conductor, a strand conductor, or the like, there is a possibility that the length of the section functioning as the conductor may become longer than in the first high-voltage conductor 21. In this case, it is effective to set the conductor cross-sectional area of the second high-voltage conductor 23 to be slightly great, thereby reducing the influence of the difference in the conductor length.

Regarding the above-described conductor cross-sectional area, the conductor cross-sectional area of the second high-voltage conductor 23 is set to be slightly greater when the conductor cross-sectional area (or the conductor diameter) of the first high-voltage conductor 21 is set to be appropriate with respect to the value of a current flowing through the first high-voltage conductor 21 which serves as a core cable, and, when the conductor cross-sectional area of the first high-voltage conductor 21 is set to be greater than necessary, the conductor cross-sectional area of the second high-voltage conductor 23 may be set to be not greater than but the same as (that is, equivalent to) the conductor cross-sectional area of the first high-voltage conductor 21. In addition, when the conductor cross-sectional area of the first high-voltage conductor 21 is set to be greater than necessary, the conductor cross-sectional area of the second high-voltage conductor 23 may be set to be slightly smaller.

Even in a case in which the conductor cross-sectional area of the second high-voltage conductor 23 is set to be slightly greater, when, for example, strand conductors are used as the second high-voltage conductor 23, the number of the strands is, simply, slightly increased, and there is only a small concern that the diameter of the multilayer coaxial cable 15 may be significantly influenced. On the other hand, in a case in which the conductor cross-sectional area is set to be greater than necessary with respect to the value of a current flowing through the first high-voltage conductor 21, it is effective to set the conductor cross-sectional area of the second high-voltage conductor 23 to be slightly smaller to decrease the diameter of the multilayer coaxial cable 15.

Furthermore, even in a case in which the conductor cross-sectional area of the first high-voltage conductor 21 is set to be greater than necessary with respect to the value of a current flowing through the first high-voltage conductor 21, the cross-sectional area greater than necessary is not significant, and there is only a small concern that the diameter of the multilayer coaxial cable 15 may be significantly influenced.

In addition, in a case in which the first high-voltage conductor and the second high-voltage conductor are made of the same material, the conductor cross-sectional area of the second high-voltage conductor 23 is set in accordance with the conductor cross-sectional area of the first high-voltage conductor 21, and therefore, even when the second high-voltage conductor 23 is a pipe conductor made of a metal pipe or the like, the thickness (that is, the wall thickness) does not become thick, and the second high-voltage conductor is formed so as to have an extremely thin thickness and a small diameter compared with a metal pipe that has thus far been used as an exterior member (in other words, a protective member).

The second high-voltage insulator 24 is a coating with respect to the second high-voltage conductor 23, and is formed by molding a well-known insulating resin material through extrusion.

The shield member 18 is a member for shielding a magnet (that is, a shield member for blocking electromagnetic waves) which covers the high-voltage positive circuit 16 and the high-voltage negative circuit 17, and, in the first embodiment, a braid formed by weaving a number of strands in a tubular shape is employed. The braid is generally a soft-copper strand plated with tin or an aluminum or aluminum alloy strand. A metal foil, for example, may be employed as the shield member 18 as long as the metal foil is capable of blocking electromagnetic waves. As long as the shield member is made of a metal foil, the shield member can be formed in a tape shape or a sheet shape, and be coiled.

The shield member 18 shields noise from the high-voltage circuits that are present inside the multilayer coaxial cable, and prevents external influence. That is, the inclusion of the shield member 18 is capable of suppressing the influence of noise on the outside or the low-voltage circuit 20. To obtain the above-described effect, the shield member 18 is grounded to the shield case for the inverter unit 4 (refer to FIG. 1) through, for example, a shield connector (not illustrated) attached to the terminal section of the shield member.

The low-voltage insulator 25 is a coating for insulating the shield member 18 and the low-voltage conductor 26, and is formed by molding a well-known insulating resin material through extrusion.

The low-voltage conductor 26 is manufactured using copper, a copper alloy, aluminum, or an aluminum alloy. The structure of the low-voltage conductor is not particularly limited as long as the low-voltage conductor 26 functions as a conductor for low-voltage use. In the present embodiment, the low-voltage conductor having a conductor cross-sectional area of 15 sq. is employed. The above-described conductor cross-sectional area or the like is an example.

When made of copper or a copper alloy, the conductor cross-sectional area of the low-voltage conductor 26 may be 10 sq. In addition, when the high-voltage positive circuit 16 and the high-voltage negative circuit 17 are set to have different sizes, the conductor cross-sectional area of the low-voltage conductor 26 may be set to 20 sq., and the low-voltage conductor 26 may be made of aluminum or an aluminum alloy.

For the low-voltage conductor 26, the same conductor structure as for the second high-voltage conductor 23 is employed. That is, any conductor structure of a braid conductor, a metal foil conductor, a spiral conductor, a pipe conductor, a strand conductor, and a tape conductor is employed.

Furthermore, another low-voltage circuit (including a low-voltage conductor and a low-voltage insulator) may be provided on the outside of the low-voltage circuit 20.

The coating member 19 is a coating located in the outermost layer, and is formed by molding a well-known insulating resin material through extrusion. The coating member 19 is a so-called sheath. Furthermore, the coating member 19 is not limited to a single-layer member as described in the first embodiment.

As described above with reference to FIGS. 1 to 3, in the multilayer coaxial cable 15, the high-voltage positive circuit 16 and the high-voltage negative circuit 17 are coaxially disposed with each other. In addition, the shield member 18 and the coating member 19 are, similarly, coaxially disposed with each other. Furthermore, the low-voltage circuit 20 is coaxially disposed between the shield member 18 and the coating member 19. As described above, since the multilayer coaxial cable 15 is an integrated cable, when the width of the multilayer coaxial cable 15 and the width of, for example, a plurality of thick cables arrayed side by side are compared, the width of the multilayer coaxial cable 15 is narrower.

Therefore, when the multilayer coaxial cable 15 is employed, it is possible to obtain a narrow width (small diameter) even when the cable includes the high-voltage positive circuit 16, the high-voltage negative circuit 17, the shield member 18, the coating member 19, and the low-voltage circuit 20. Therefore, it is possible to save a space for the routing of the cable.

In addition, according to the multilayer coaxial cable 15, since the cable has a narrow width (small diameter) as described above, it is possible to decrease the size of the exterior member that houses and protects the cable (the protective member).

In addition, according to the multilayer coaxial cable 15, since the cable has an integrated coaxial constitution as described above, when compared with a case in which, for example, a plurality of thick cables is arrayed, the cable can be easily bent in any direction. As a result, it is possible to improve the degree of freedom in routing the cable.

In addition, according to the multilayer coaxial cable 15, since the cable has an integrated coaxial constitution, it is needless to say that the routing properties can be improved, and it becomes easy to meet the requirement of multiple power supplies arising from the change in the vehicle environment.

In addition, according to the multilayer coaxial cable 15, since the cable has an integrated constitution, it is possible to reduce the number of times of work to insert the cable into the protective member. As a result, it is possible to improve the workability.

Second Embodiment

Figure 4:
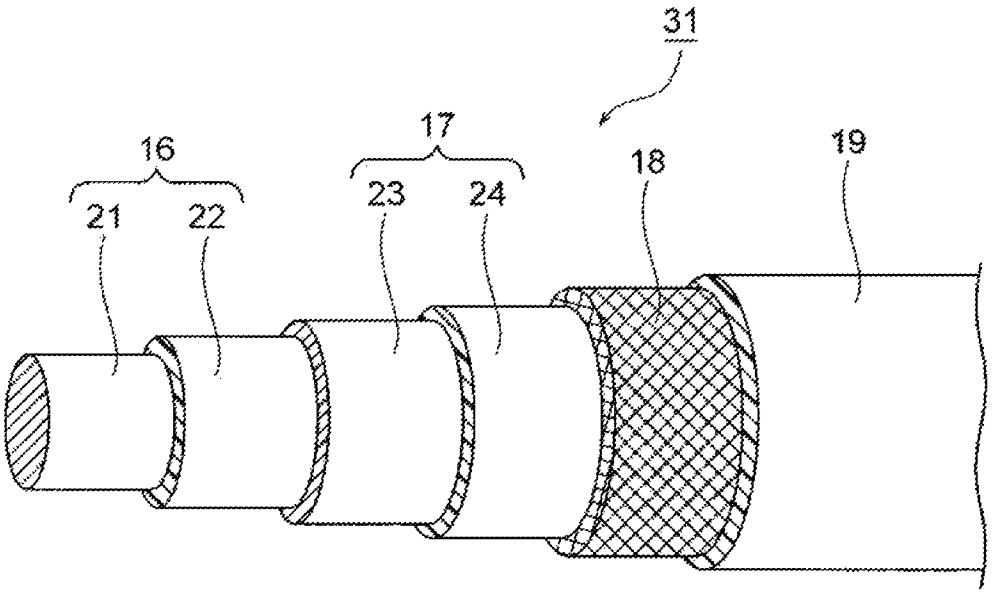
FIG. 4 is a perspective view illustrating a constitution of a multilayer coaxial cable of a second embodiment.
Figure 5:
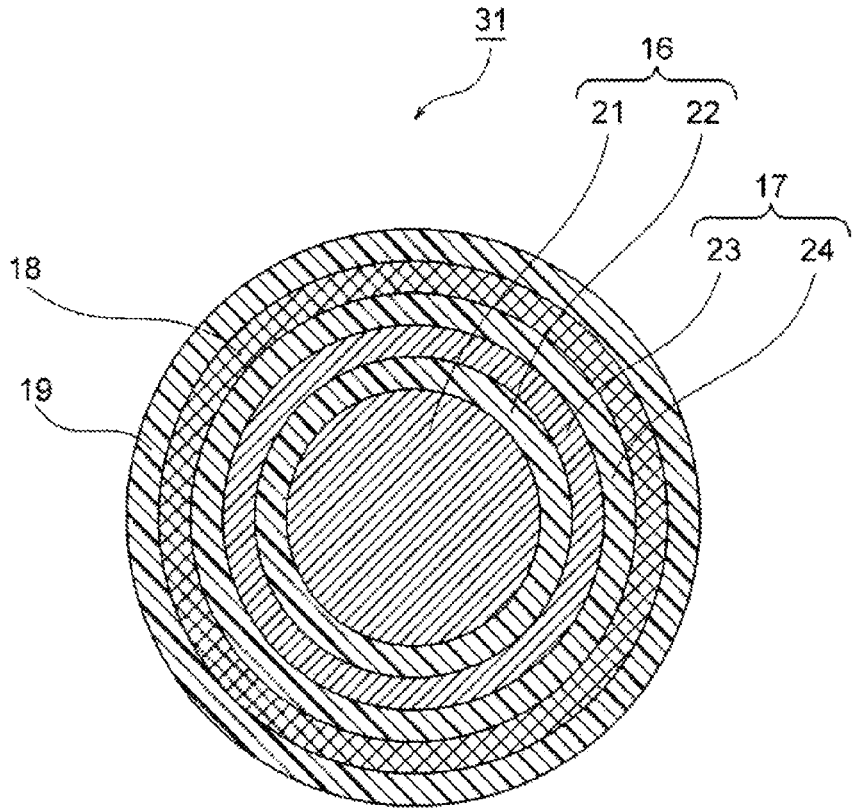
FIG. 5 is a cross-sectional view of the multilayer coaxial cable of FIG. 4.

Hereinafter, a second embodiment of the multilayer coaxial cable according to the present invention will be described with reference to FIGS. 4 and 5. FIG. 4 is a perspective view illustrating the constitution of a multilayer coaxial cable of the second embodiment. In addition, FIG. 5 is a cross-sectional view of the multilayer coaxial cable of FIG. 4. Constitution members that are basically the same as in the first embodiment will be give the same reference symbols, and detailed description thereof will not be made. In addition, the multilayer coaxial cable of the second embodiment is included in a wire harness routed in the same manner as the wire harness 9 in the first embodiment illustrated in FIG. 1.

In FIGS. 4 and 5, a single string of the multilayer coaxial cable 31 includes the high-voltage positive circuit 16 and the high-voltage negative circuit 17. That is, the multilayer coaxial cable 31 includes two-system high-voltage circuits. In addition, the multilayer coaxial cable 31 includes the shield member 18 and the coating member 19. The multilayer coaxial cable 31 is constituted so that all the above-described components are coaxially integrated. In addition, the multilayer coaxial cable 31 has a round electrically-conducting path cross-sectional shape. Unlike the first embodiment, the multilayer coaxial cable 31 of the second embodiment does not include the low-voltage circuit.

The multilayer coaxial cable 31 will be more specifically described. The multilayer coaxial cable 31 includes the first high-voltage conductor 21 having a round cross-sectional shape located in the center of an electrically-conducting path and the first high-voltage insulator 22 that coats the outer circumference of the first high-voltage conductor 21 in a predetermined thickness, and forms a layer shape. In addition, the multilayer coaxial cable 31 includes the second high-voltage conductor 23 that is provided on the outside of the first high-voltage insulator 22 and forms a layer shape and the second high-voltage insulator 24 that coats the outer circumference of the second high-voltage conductor 23 in a predetermined thickness, and forms a layer shape. Furthermore, the multilayer coaxial cable 31 includes the shield member 18 that is provided on the outside of the second high-voltage insulator 24 and forms a layer shape and the coating member 19 that coats the outer circumference of the shield member 18 in a predetermined thickness, and forms a layer shape.

As is clear from the above-described constitution, the multilayer coaxial cable 31 of the second embodiment exhibits the same effects as the multilayer coaxial cable 15 of the first embodiment. That is, it is possible to save a space for the routing of the cable, or to decrease the size of the exterior member. In addition, it is possible to alleviate the restriction of the bending direction and improve the degree of freedom or workability during the routing of the cable.

Third Embodiment

Figure 6:
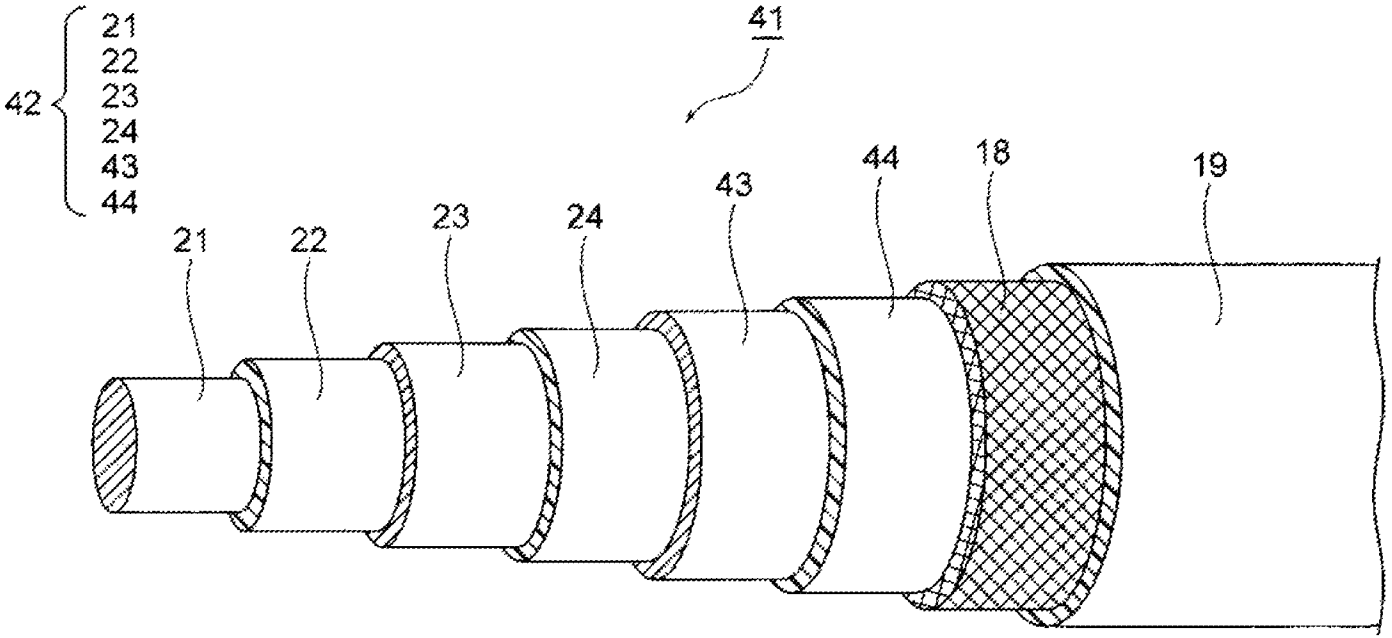
FIG. 6 is a perspective view illustrating a constitution of a multilayer coaxial cable of a third embodiment.
Figure 7:
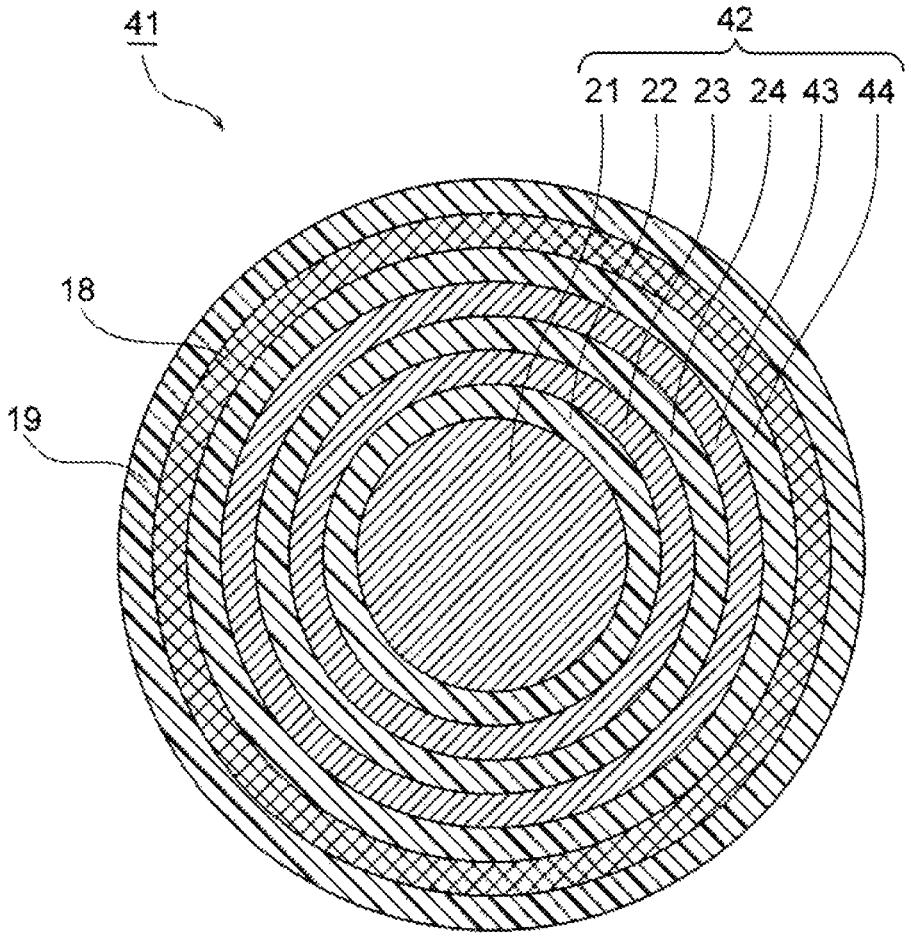
FIG. 7 is a cross-sectional view of the multilayer coaxial cable of FIG. 6.
Figure 8A:
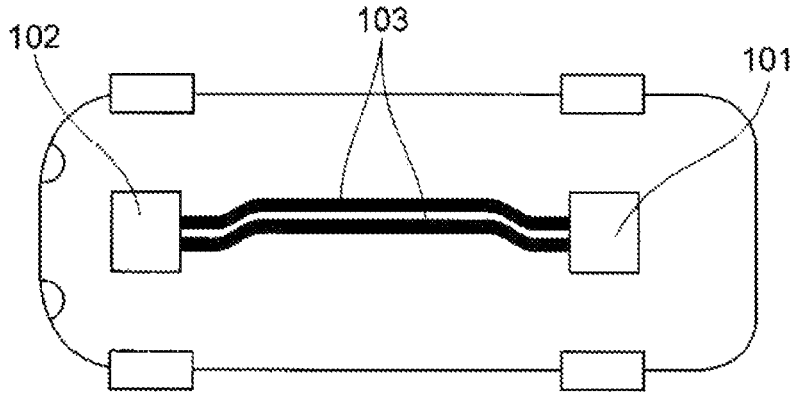
FIGS. 8A to 8C are views illustrating high-voltage electrical power cables as examples of the related art.
Figure 8B:
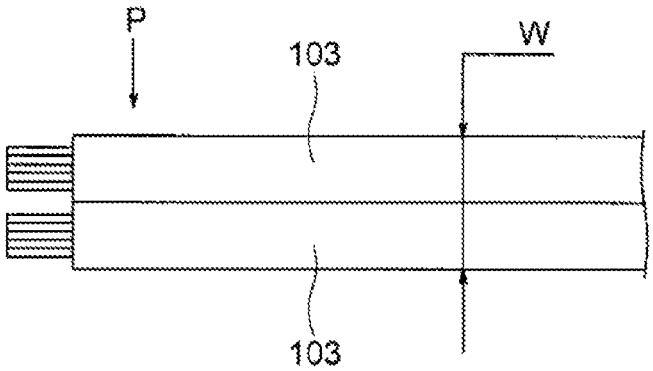
Figure 8C:
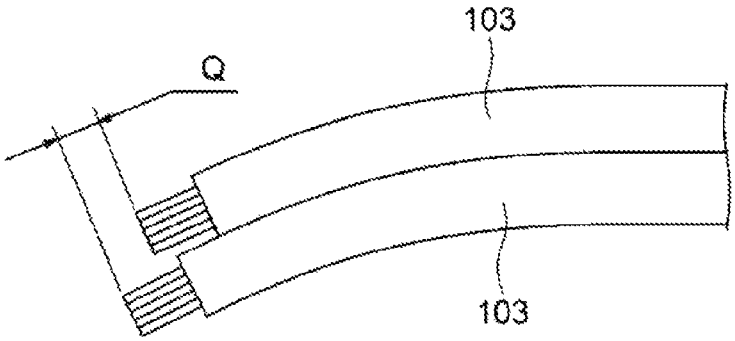

Hereinafter, a third embodiment of the multilayer coaxial cable according to the present invention will be described with reference to FIGS. 6 and 7. FIG. 6 is a perspective view illustrating the constitution of a multilayer coaxial cable of the third embodiment. In addition, FIG. 7 is a cross-sectional view of the multilayer coaxial cable of FIG. 6. Constitution members that are basically the same as in the first embodiment, 2 will be give the same reference symbols, and detailed description thereof will not be made. In addition, the multilayer coaxial cable of the third embodiment is included in a wire harness routed in the same manner as the wire harness 9 in the first embodiment illustrated in FIG. 1.

In FIGS. 6 and 7, a single string of the multilayer coaxial cable 41 includes three three-phase alternate current high-voltage circuits 42. That is, in addition to the high-voltage positive circuit 16 (first high-voltage circuit) and the high-voltage negative circuit 17 (second high-voltage circuit), the multilayer coaxial cable includes a third high-voltage circuit. In addition, similar to the first embodiment, 2, the multilayer coaxial cable 41 includes the shield member 18 and the coating member 19. The multilayer coaxial cable 41 is constituted so that all the above-described components are coaxially integrated. In addition, the multilayer coaxial cable 41 has a round electrically-conducting path cross-sectional shape. In the third embodiment, the multilayer coaxial cable 41 does not include the low-voltage circuit. However, the multilayer coaxial cable is not limited to the above-described constitution, and may include the same low-voltage circuit as in the first embodiment provided between the shield member 18 and the coating member 19.

The multilayer coaxial cable 41 will be more specifically described. The multilayer coaxial cable 41 includes the first high-voltage conductor 21 having a round cross-sectional shape located in the center of an electrically-conducting path and the first high-voltage insulator 22 that coats the outer circumference of the first high-voltage conductor 21 in a predetermined thickness, and forms a layer shape. In addition, the multilayer coaxial cable 41 includes the second high-voltage conductor 23 that is provided on the outside of the first high-voltage insulator 22 and forms a layer shape and the second high-voltage insulator 24 that coats the outer circumference of the second high-voltage conductor 23 in a predetermined thickness, and forms a layer shape. Furthermore, the multilayer coaxial cable 41 includes a third high-voltage conductor 43 that is provided on the outside of the second high-voltage insulator 24 and forms a layer shape and a third high-voltage insulator 44 that coats the outer circumference of the third high-voltage conductor 43 in a predetermined thickness, and forms a layer shape. Furthermore, the multilayer coaxial cable 41 includes the shield member 18 that is provided on the outside of the third high-voltage insulator 44 and forms a layer shape and the coating member 19 that coats the outer circumference of the shield member 18 in a predetermined thickness, and forms a layer shape. That is, the third high-voltage circuit includes the third high-voltage conductor 43 and the third high-voltage insulator.

For the third high-voltage conductor 43, the same conductor structure as for the second high-voltage conductor 23 is employed. That is, any conductor structure of a braid conductor, a metal foil conductor, a spiral conductor, a pipe conductor, a strand conductor, and a tape conductor is employed. The third high-voltage conductor 43 is manufactured using copper, a copper alloy, aluminum, or an aluminum alloy.

The third high-voltage insulator 44 is a coating for insulating the shield member 18 and the third high-voltage conductor 43, and is formed by molding a well-known insulating resin material through extrusion.

As is clear from the above-described constitution, the multilayer coaxial cable 41 of the third embodiment exhibits the same effects as the multilayer coaxial cable 15 of the first embodiment. That is, it is possible to save a space for the routing of the cable, or to decrease the size of the exterior member. In addition, it is possible to alleviate the restriction of the bending direction and improve the degree of freedom or workability during the routing of the cable.

Hereinafter, the multilayer coaxial cables 15, 31, and 41 of the embodiments will be summarized.

(1) The multilayer coaxial cable 15, 31, or 41 includes the first high-voltage circuit (the high-voltage positive circuit 16) including the first high-voltage conductor 21 and the first high-voltage insulator 22 that is disposed on the outside of the first high-voltage conductor 21 coaxially with the first high-voltage conductor 21. In addition, the multilayer coaxial cable 15, 31, or 41 includes the second high-voltage circuit (the high-voltage negative circuit 17) including the second high-voltage conductor 23 that is disposed on the outside of the first high-voltage insulator 22 coaxially with the first high-voltage insulator 22 and the second high-voltage insulator 24 that is disposed on the outside of the second high-voltage conductor 23 coaxially with the second high-voltage conductor 23. Furthermore, the multilayer coaxial cable 15, 31, or 41 includes the conductive shield member 18 that is disposed on the outside of the second high-voltage insulator 24 coaxially with the second high-voltage insulator 24 and the coating member 19 that is disposed on the outside of the shield member 18 coaxially with the shield member 18.

(2) The multilayer coaxial cable 15 further includes the low-voltage circuit 20 including the low-voltage insulator 25 that is disposed on the outside of the shield member 18 coaxially with the shield member 18 and the low-voltage conductor 26 that is disposed on the outside of the low-voltage insulator 25 coaxially with the low-voltage insulator 25.

(3) In the multilayer coaxial cable 15, the conductor cross-sectional area of the low-voltage conductor 26 is substantially the same as the conductor cross-sectional area of either or both the first high-voltage conductor 21 and the second high-voltage conductor 23.

(4) The multilayer coaxial cable 15 can be constituted so that the conductor cross-sectional area of the low-voltage conductor 26 is different from the conductor cross-sectional area of either or both the first high-voltage conductor 21 and the second high-voltage conductor 23.

(5) In the multilayer coaxial cable 15, one (in the embodiment, the high-voltage positive circuit 16 that is the first high-voltage circuit) of the first high-voltage circuit and the second high-voltage circuit is a positive circuit and the other (in the embodiment, the high-voltage negative circuit 17 that is the second high-voltage circuit) is a negative circuit.

(6) The multilayer coaxial cable 41 further includes the third high-voltage circuit including the third high-voltage conductor 43 that is disposed on the outside of the second high-voltage insulator 24 coaxially with the second high-voltage insulator 24, and the third high-voltage insulator 44 that is disposed on the outside of the third high-voltage conductor 43 coaxially with the third high-voltage conductor 43. In addition, a three-phase alternate current circuit is formed using the first high-voltage circuit, the second high-voltage circuit, and the third high-voltage circuit.

(7) In the multilayer coaxial cable 15, 31, 41, at least the first high-voltage conductor 21 is made of aluminum or an aluminum alloy.

(8) In the multilayer coaxial cable 15, 31, 41, the shield member 18 is made of a braid or a metal foil.

(9) In the multilayer coaxial cable 15, 31, 41, another constitution is disposed in a layer shape with respect to the first high-voltage conductor 21 that is disposed around an electrically-conducting path, and the electrically-conducting path cross-sectional shape of the multilayer coaxial cable 15, 31, or 41 is a round shape.

Additionally, it is needless to say that, within the scope of the object of the present invention, the present invention can be modified and carried out in various manners.

The present application claims priority on the basis of Japanese Patent Application No. 2012-177738, filed on Aug. 10, 2012, the content of which is incorporated herein by reference.

According to the multilayer coaxial cable of the present invention, it is possible to provide a multilayer coaxial cable which is capable of saving a space for the routing of the cable and decreasing the size of a protective member, and is capable of removing the restriction of the bending direction and improving the degree of freedom or workability, and therefore the present invention is useful.

What is claimed is:

1. A multilayer coaxial cable for a hybrid vehicle or an electric vehicle comprising:

a first high-voltage circuit including a first high-voltage conductor and a first high-voltage insulator that is disposed on an outside of the first high-voltage conductor coaxially with the first high-voltage conductor;

a second high-voltage circuit including a second high-voltage conductor that is disposed on an outside of the first high-voltage insulator coaxially with the first high-voltage insulator and a second high-voltage insulator that is disposed on an outside of the second high-voltage conductor coaxially with the second high-voltage conductor;

a conductive shield member that is disposed on an outside of the second high-voltage insulator coaxially with the second high-voltage insulator;

a coating member that is disposed on an outside of the shield member coaxially with the shield member;

a low-voltage circuit including a low-voltage insulator that is disposed on the outside of the shield member coaxially with the shield member and a low-voltage conductor that is disposed on an outside of the low-voltage insulator coaxially with the low-voltage insulator, and a third high-voltage circuit including a third-high voltage conductor that is disposed on the outside of the second high-voltage insulator coaxially with the second high-voltage insulator, and a third high-voltage insulator that is disposed on an outside of the third high-voltage conductor coaxially with the third high-voltage conductor, wherein the low-voltage circuit is provided between the shield member and the coating member;

wherein the conductive shield member is comprised of a braid;

wherein the conductive shield member is electrically configured so as to shield the first high-voltage circuit and the second high-voltage circuit from electromagnetic interference;

wherein a conductor cross-sectional area of the second high-voltage conductor is the same as or more than a conductor cross-sectional area of the first high-voltage conductor;

wherein a three-phase alternate current circuit is formed by the first high-voltage circuit, the second high-voltage circuit, and the third high-voltage circuit; and wherein the multilayer coaxial cable has a first end and a second end, the first end of the multilayer coaxial cable being electrically connected to a battery of the hybrid vehicle or the electric vehicle and the second end of the multilayer coaxial cable being electrically connected to an inverter unit of the hybrid vehicle or the electric vehicle.

2. The multilayer coaxial cable according to claim 1, wherein a conductor cross-sectional area of the low-voltage conductor is substantially the same as the conductor cross-sectional area of at least one of the first high-voltage conductor and the second high-voltage conductor.

3. The multilayer coaxial cable according to claim 1, wherein a conductor cross-sectional area of the low-voltage conductor is different from the conductor cross-sectional area of at least one of the first high-voltage conductor and the second high-voltage conductor.

4. The multilayer coaxial cable according to claim 1, wherein one of the first high-voltage circuit and the second high-voltage circuit is a positive circuit and the other is a negative circuit.

5. The multilayer coaxial cable according to claim 1, wherein at least the first high-voltage conductor is made of aluminum or an aluminum alloy.

6. The multilayer coaxial cable according to claim 1, wherein another constitution is disposed in a layer shape with respect to the first high-voltage conductor that is disposed around an electrically-conducting path, and an electrically-conducting path cross-sectional shape of the multilayer coaxial cable is a round shape.

7. The multilayer coaxial cable according to claim 1, wherein, in a normal state, the conductive shield member does not carry electricity.

8. A multilayer coaxial cable for a hybrid vehicle or an electric vehicle comprising:

a first high-voltage circuit including a first high-voltage conductor and a first high-voltage insulator that is disposed on an outside of the first high-voltage conductor coaxially with the first high-voltage conductor;

a second high-voltage circuit including a second high-voltage conductor that is disposed on an outside of the first high-voltage insulator coaxially with the first high-voltage insulator and a second high-voltage insulator that is disposed on an outside of the second high-voltage conductor coaxially with the second high-voltage conductor;

a conductive shield member that is disposed on an outside of the second high-voltage insulator coaxially with the second high-voltage insulator;

a coating member that is disposed on an outside of the shield member coaxially with the shield member;

a low-voltage circuit including a low-voltage insulator that is disposed on the outside of the shield member coaxially with the shield member and a low-voltage conductor that is disposed on an outside of the low-voltage insulator coaxially with the low-voltage insulator, and a third high-voltage circuit including a third high-voltage conductor that is disposed on the outside of the second high-voltage insulator coaxially with the second high-voltage insulator, and a third high-voltage insulator that is disposed on an outside of the third high-voltage conductor coaxially with the third high-voltage conductor, wherein the low-voltage circuit is provided between the shield member and the coating member;

wherein the conductive shield member is comprised of a metal foil;

wherein the conductive shield member is electrically configured so as to shield the first high-voltage circuit and the second high-voltage circuit from electromagnetic interference;

wherein a conductor cross-sectional area of the second high-voltage conductor is the same as or more than a conductor cross-sectional area of the first high-voltage conductor;

wherein a three-phase alternate current circuit is formed by the first high-voltage circuit, the second high-voltage circuit, and the third high-voltage circuit; and wherein the multilayer coaxial cable has a first end and a second end, the first end of the multilayer coaxial cable being electrically connected to a battery of the hybrid vehicle or the electric vehicle and the second end of the multilayer coaxial cable being electrically connected to an inverter unit of the hybrid vehicle or the electric vehicle.

9. The multilayer coaxial cable according to claim 8, wherein, in a normal state, the conductive shield member does not carry electricity.

* * * * *